US012247445B2

(12) United States Patent
Wheater et al.

(10) Patent No.: US 12,247,445 B2
(45) **Date of Patent: *Mar. 11, 2025**

(54) WIRELINE CASED-HOLE STANDOFF

(71) Applicants: Guy Wheater, London (GB); Stuart Huyton, Elgin (GB)

(72) Inventors: Guy Wheater, London (GB); Stuart Huyton, Elgin (GB)

( * ) Notice: Subject to any disclaimer, the term of this patent is extended or adjusted under 35 U.S.C. 154(b) by 0 days.

This patent is subject to a terminal disclaimer.

(21) Appl. No.: 18/367,238

(22) Filed: Sep. 12, 2023

(65) Prior Publication Data

US 2024/0003201 A1 Jan. 4, 2024

Related U.S. Application Data

(63) Continuation of application No. 17/803,168, filed on Sep. 21, 2021, now Pat. No. 11,753,879, which is a continuation of application No. 16/882,927, filed on May 26, 2020, now Pat. No. 11,125,025.

(51) Int. Cl.
*E21B 17/10* (2006.01)

(52) U.S. Cl.
CPC ..... *E21B 17/1085* (2013.01)

(58) Field of Classification Search
CPC ..... E21B 17/1085; E21B 17/10
See application file for complete search history.

(56) References Cited

U.S. PATENT DOCUMENTS

| | | | | |
|---|---|---|---|---|
| 11,125,025 | B1 * | 9/2021 | Wheater | E21B 17/1035 |
| 11,753,879 | B2 * | 9/2023 | Wheater | E21B 17/10 166/378 |
| 2012/0018145 | A1 | 1/2012 | Wheater et al. | |
| 2012/0031609 | A1 | 2/2012 | Wheater et al. | |
| 2013/0161441 | A1 | 6/2013 | Bjornenak et al. | |
| 2019/0169976 | A1 | 6/2019 | Wheater et al. | |

OTHER PUBLICATIONS

USPTO Notice of Allowance for U.S. Appl. No. 16/882,927 dated May 5, 2021.
USPTO Non-Final Office Action for U.S. Appl. No. 16/882,927 dated May 26, 2020.
International Search Report and Written Opinion for Application No. PCT/GB2021/051282 dated Aug. 5, 2021.
(Continued)

*Primary Examiner* — Kristyn A Hall
(74) *Attorney, Agent, or Firm* — Tumey L.L.P.

(57) ABSTRACT

The present invention relates to a wireline cased-hole standoff (WCSO) for installation on a wireline cable of a wellbore logging tool. In embodiments, WCSO may be capable of significantly reducing wireline cable drag in a cased-hole section of a well or wellbore as well as reduce logging tensions and improve force transmission from wellbore surface to logging tool cable head during wireline logging operations. In one embodiment, WCSO comprises two cable insert halves, two opposing WCSO body halves (an upper body and a lower body), and two outer shells (an upper low-friction shell and a lower low-friction shell). Such components may be fastened together onto the wireline cable using screws, bolts, dowel pins, spigots, or any combinations thereof.

20 Claims, 4 Drawing Sheets

(56) References Cited

OTHER PUBLICATIONS

Extended European Search Report for Application No. 21176043.4 dated Oct. 7, 2021.
USPTO Notice of Allowance for U.S. Appl. No. 17/803,168 dated Apr. 28, 2023.
USPTO Non-Final Office Action for U.S. Appl. No. 17/803,168 dated Dec. 14, 2022.
USPTO Issue Notification for U.S. Appl. No. 16/882,927 dated Sep. 1, 2021.
USPTO Non-Final Office Action for U.S. Appl. No. 16/882,927 dated Dec. 21, 2020.
USPTO Issue Notification for U.S. Appl. No. 17/803,168 dated Aug. 23, 2023.

* cited by examiner

WIRELINE CASED-HOLE STANDOFF

CROSS-REFERENCE TO RELATED APPLICATIONS

This application is a continuation application of U.S. patent application Ser. No. 17/803,168 filed Sep. 21, 2021 which is a continuation application of U.S. patent application Ser. No. 16/882,927 filed May 26, 2020 issued as U.S. Pat. No. 11,125,025 on Sep. 21, 2021, the entire contents of which are incorporated herein by reference thereto.

STATEMENT REGARDING FEDERALLY SPONSORED RESEARCH OR DEVELOPMENT

Not applicable.

BACKGROUND OF THE INVENTION

Field of the Invention

The present invention relates to the field of wireline cable performance during logging operations of an oil well. More particularly, the present invention relates to a device for use with a wireline cable to improve the wireline cable performance during logging operations in a cased-hole section of a well or wellbore.

Background of the Invention

Wireline logging is a common operation in the oil industry whereby down-hole electrical tools are conveyed on a wireline (also known as an "e-line" or a "slickline" in industry parlance) to evaluate the integrity or state of tubing, casing, cement, and/or perforations in a wellbore. Typically, evaluations will occur in wellbores comprising geometries with various curves, bends, and/or turns (e.g., doglegs) which may significantly impact the performance of wireline logging.

Currently, during a logging operation, the wireline of a logging tool may experience high drag and high tension along the curvatures of a wellbore. These conditions can contribute to damage and/or wear of both the wellbore and the wireline. For example, a wireline experiencing high drag and high tension may damage a wellbore by cutting grooves into the casing. Casing grooves may compromise the structural integrity of the wellbore, and can be particularly problematic in wells requiring a minimum casing thickness for pressure testing. Additionally, a wireline experiencing high drag and high tension may be subjected to significant wear-and-tear due to the increase in friction and force. Wear-and-tear of the wireline may be mitigated by using higher grade cables; however, such use often times incurs additional unwanted cost.

Furthermore, high drag and high-tension conditions may prevent a wireline logging tool from reaching its target destination in a wellbore. In some wells, particularly in long extension wells, wireline logging tools utilize motorized devices such as tractors to drive the tools downhole. However, a wireline experiencing high drag and high tension due to the curvatures in a wellbore may cause a tractor to run out of power before reaching a target area. This is due to the cable drag and tension forces which hinder movement of the tractor and requires the tractor to utilize more power when traveling in the wellbore. When this occurs, the tractor will typically exhaust all power before getting the logging tool to its target destination in the wellbore.

Consequently, there is a need for a device for use with a wireline cable to improve wireline cable performance during logging operations through the mitigation of high drag and high-tension conditions in a wellbore.

BRIEF SUMMARY OF SOME OF THE PREFERRED EMBODIMENTS

These and other needs in the art are addressed in one embodiment by a wireline cased-hole standoff (WCSO) comprising a pair of cable insert halves, a pair of opposing WCSO body halves, a pair of outer shells, and one or more fasteners, wherein the one or more fasteners are configured to couple the pair of cable insert halves, the pair of opposing WCSO body halves, and the pair of outer shells together onto a wireline cable.

These and other needs in the art are addressed in one embodiment by a wireline assembly comprising a wireline cable, and a WCSO, wherein the WCSO comprises a pair of cable insert halves, a pair of opposing WCSO body halves, a pair of outer shells, and one or more fasteners, wherein the one or more fasteners are configured to couple the pair of cable insert halves, the pair of opposing WCSO body halves, and the pair of outer shells together onto the wireline cable.

These and other needs in the art are addressed in one embodiment by a method for reducing wireline cable drag and tension during wireline logging operations comprising coupling one or more wireline cased-hole standoffs (WCSOs) to a wireline cable, wherein the one or more WCSOs comprise a pair of cable insert halves, a pair of opposing WCSO body halves, a pair of outer shells, and one or more fasteners, wherein the one or more fasteners are configured to couple the pair of cable insert halves, the pair of opposing WCSO body halves, and the pair of outer shells together onto the wireline cable.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
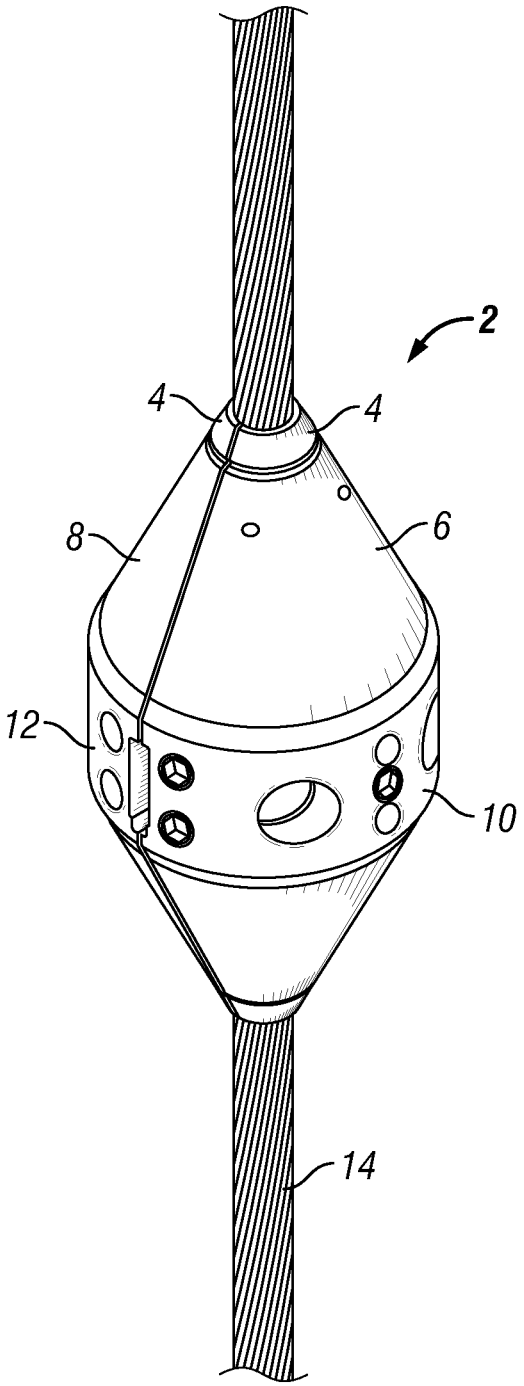
FIG. 1 illustrates an isometric view of a wireline cased-hole standoff in accordance with one embodiment of the present invention.

FIG. 1 illustrates an embodiment of a wireline cased-hole standoff (WCSO) 2. In embodiments, WCSO 2 may be a device for installation on a wireline cable of a wellbore logging tool, capable of significantly reducing wireline cable drag in a cased oil well or wellbore. In reducing cable drag, WCSO 2 may reduce logging tensions and improve force transmission from wellbore surface to logging tool cable head during wireline logging operations. In embodiments, WCSO 2 comprises two cable insert halves 4, two opposing WCSO body halves (an upper body 6 and a lower body 8), and two outer shells (an upper low-friction shell 10 and a lower low-friction shell 12). As illustrated, cable insert halves 4, upper and lower bodies 6 and 8, and upper and lower low-friction shells 10 and 12 may be fastened together onto a wireline cable 14. In embodiments, coupling of these components may be accomplished using screws, bolts, dowel pins, spigots, or any combinations thereof.

Figure 2A:
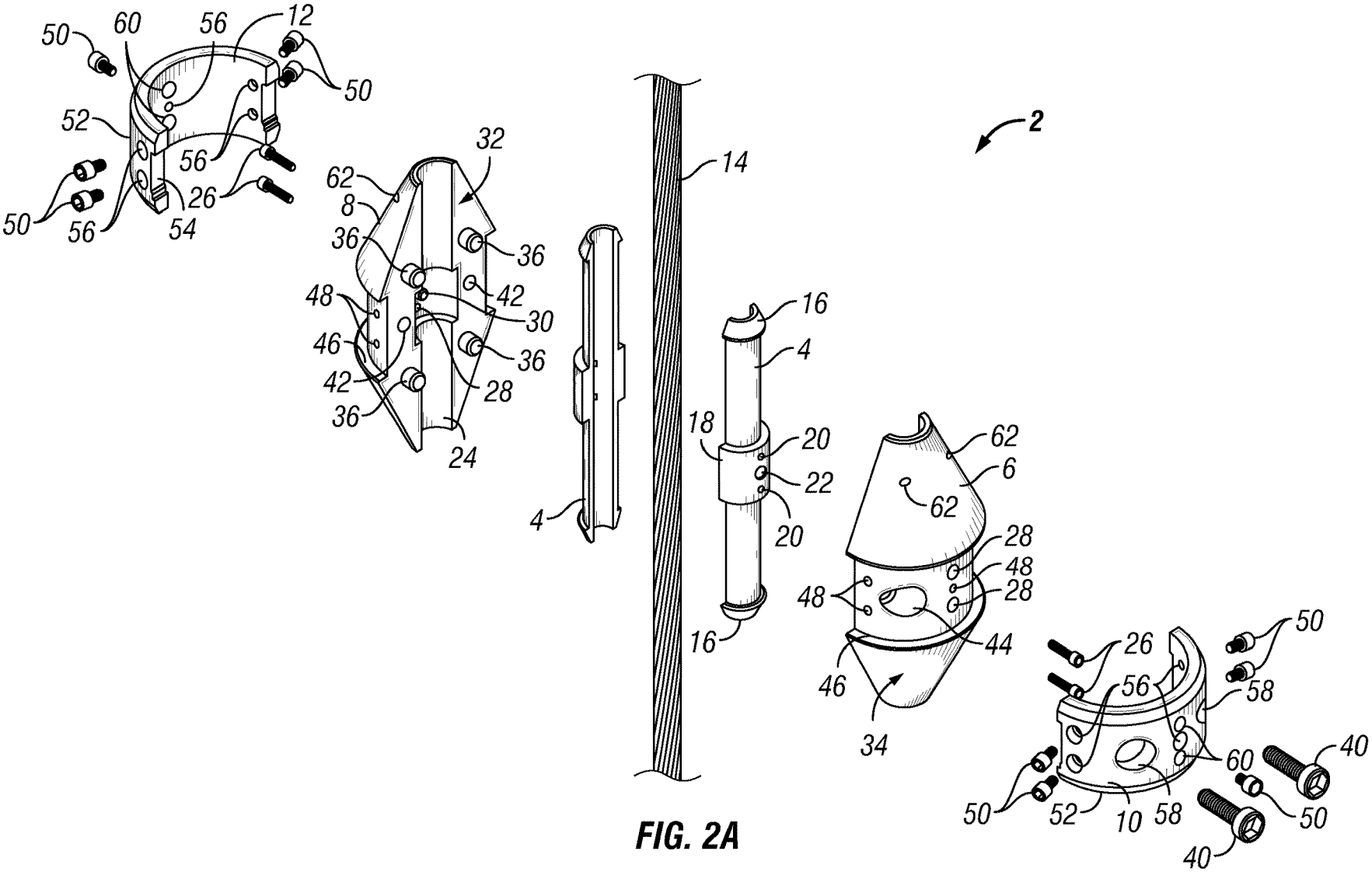
FIGS. 2A and 2B illustrate exploded views of a wireline cased-hole standoff in accordance with one embodiment of the present invention from opposing perspectives.
Figure 2B:
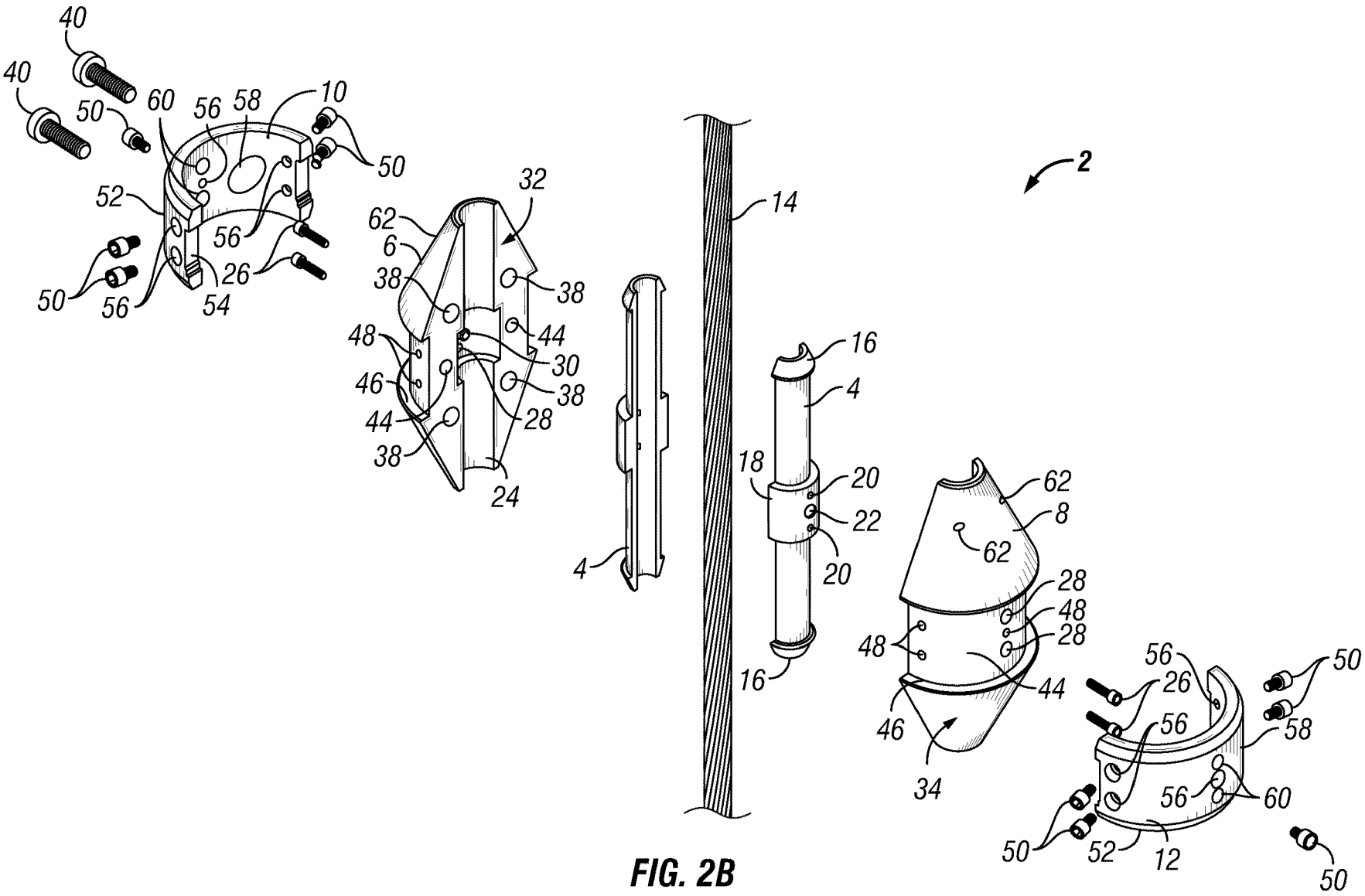

FIGS. 2A and 2B each illustrate an exploded view of WCSO 2 from opposing perspectives. As illustrated, cable insert halves 4 may be concentrically disposed between wireline cable 14 and upper and lower bodies 6 and 8, such that cable insert halves 4 may be in direct contact with wireline cable 14 and at least partially encased within upper and lower bodies 6 and 8. In embodiments, cable insert halves 4 may mate together to form a central bore in which to pass wireline cable 14 through WCSO 2. Each cable insert half 4 may be in the general shape of a hollow, half cylinder and comprise flanged ends 16 disposed about the end portions of each cable insert half 4 and a central flange 18 disposed about the middle portion of each cable insert half 4. Flanged ends 16 and central flanges 18, alone or in combination, may be used to prevent axial movement of cable insert halves 4 within WCSO 2. In embodiments, flanged ends 16 may be tapered and between about 1.0 cm and about 3.0 cm in length. Further, flanged ends 16 may extend beyond upper and lower bodies 6 and 8, while the remaining portions of each cable insert half 4, including central flanges 18, may fit into corresponding cable insert recess portions 24 of upper and lower bodies 6 and 8. In embodiments, each central flange 18 may comprise cable insert fastener threads 20 which receive cable insert fasteners 26 and an anti-rotation spigot recess 22 which receives an anti-rotation spigot 30. As illustrated, each cable insert half 4 may comprise two cable insert fastener threads 20 to correspond with two cable insert fasteners 26 and one anti-rotation spigot recess 22 to correspond with one anti-rotation spigot 30.

In embodiments, cable insert halves 4 may be available in various sizes to ensure the central bore diameter of WCSO 2 corresponds to the diameter of wireline cable 14. In embodiments, wireline cable 14 may vary in diameter between about 5.0 mm and about 25.0 mm. During installation of WCSO 2, cable insert halves 4 may be configured to slightly deform around an outer armor of wireline cable 14 to prevent physical damage to the wireline. To accomplish this deformity, cable insert halves 4 may be manufactured from any suitable material, such as, without limitation, aluminum and other soft metals. Further, cable insert halves 4 may be disposable. In embodiments, cable insert halves 4 may be manufactured from aluminum, and because aluminum may be considerably softer than the outer armor of wireline cable 14, there may be a reduced risk of damage to the wireline during installation of WCSO 2. At installation, wireline cable 14 may be any suitable diameter required for a particular logging operation and may even vary in diameter size along its length, taking into account any manufacturing tolerances and varying degrees of wear or distortion. Therefore, a range of different cable insert halves 4 may be employed for a plurality of WCSOs 2 installed on wireline cable 14 to ensure a proper fit along the length of wireline cable 14 and prevent slippage on and/or damage to wireline cable 14. In embodiments, the length of cable insert halves 4 may be between about 10.0 cm and about 20.0 cm, or alternatively between about 10.0 cm and about 15.0 cm. In embodiments, the length of cable insert halves 4 may be about 14.478 cm.

As set forth above, cable insert halves 4 may be encased within the opposing WCSO body halves of upper and lower bodies 6 and 8. In embodiments, upper and lower bodies 6 and 8 may be of similar structure and in the general shape of a tapered half cylinder comprising an inner surface 32 and an outer surface 34. Inner surface 32 of both upper and lower bodies 6 and 8 may comprise cable insert recess portions 24 having anti-rotation spigots 30 and insert fastener clearance holes 28. In embodiments, insert fastener clearance holes 28 may extend from inner surface 32 to outer surface 34 of upper and lower bodies 6 and 8. In embodiments, cable insert recess portions 24 may be configured in shape to accurately receive cable insert halves 4, such that anti-rotation spigot 30 fits into anti-rotation spigot recesses 22, thus preventing radial rotation of cable insert halves 4 within WCSO 2. Further, cable insert halves 4 may be secured within cable insert recess portions 24 with cable insert fasteners 26, such that cable insert fasteners 26 may travel through insert fastener clearance holes 28 and may be received by or fit into cable insert fastener threads 20. In embodiments, cable insert fasteners 26 may be any suitable fasteners, bolts, or screws such as, without limitation, small cap head bolts or screws. In embodiments, cable insert fasteners 26 may have a diameter of 3 mm (i.e., M3 bolts).

In embodiments, upper and lower bodies 6 and 8, which securely encase cable insert halves 4, may be couple together onto wireline cable 14. Coupling of upper and lower bodies 6 and 8 onto wireline cable 14 may be accomplished via dowel pins 36 and dowel pin recesses 38. In embodiments, dowel pin recesses 38, configured to receive dowel pins 36, may be disposed on inner surface 32 of both upper and lower WCSO bodies 6 and 8. In embodiments, one dowel pin 36 may correspond to two dowel pin recesses 38, one recess being disposed on inner surface 32 of upper body 6 and the other recess being disposed on inner surface 32 of lower body 8. As illustrated in FIGS. 2A and 2B, upper body 6 and lower body 8 may each comprise four dowel pins recesses 38 to receive four dowel pins 36. In embodiments, dowel pins 36 may be 4×8 mm pins.

In addition to dowel pins 36 and dowel pin recesses 38, coupling of upper and lower bodies 6 and 8 may be accomplished via clamping bolts 40, clamping bolt female threads 42, and clamping bolt clearance holes 44. In embodiments, clamping bolt female threads 42 may be disposed on upper body 6 or lower body 8 with corresponding clamping bolt clearance holes 44 disposed on the opposing body relative to clamping bolt female threads 42. For instance, as illustrated on FIGS. 2A and 2B, clamping bolt female threads 42 may be disposed on inner surface 32 of lower body 8 and have corresponding clamping bolt clearance holes 44 disposed on upper body 6. In embodiments, clamping bolt clearance holes 44 may extend from inner surface 32 to outer surface 34 of upper body 6. Upper body 6 or lower body 8 may comprise two clamping bolt female threads 42 or two clamping bolt clearance holes 44, or any combinations thereof. In embodiments, clamping bolts 40 may travel through clamping bolt clearance holes 44 and may be received by or fit into clamping bolt female threads 42, such that upper and lower bodies 6 and 8, along with insert cable halves 4, may be securely coupled and clamped onto wireline cable 14. During installation, clamping bolts 40 may be torqued to a consistently safe limit with a calibrated torque wrench which in turn may reduce the risk of damage to wireline cable 14 from cable insert halves 4 when clamping bolts 40 may be tightened. In embodiments, clamping bolts 40 may be any suitable fasteners, bolts, or screws such as, without limitation, two large cap head bolts or screws. In embodiments, clamping bolts 40 may have a diameter of 8 mm (i.e., M8 bolts).

The two opposing WCSO body halves, upper body 6 and lower body 8, may be manufactured from any suitable material such as, without limitation, stainless steel or other high-performance material. In embodiments, upper and lower bodies 6 and 8 may be manufactured from stainless steel. Upper and lower bodies 6 and 8 may also be surface hardened (e.g., vacuum hardened) to improve wear resistance during use. Further, upper and lower bodies 6 and 8 may be available in various sizes to accommodate the wellbore in which WCSO 2 may be used. In embodiments, the length of upper and lower bodies 6 and 8 may be between about 10.0 cm and about 15.0 cm, or alternatively between about 12.0 cm and about 13.0 cm. In embodiments, the length of upper and lower bodies 6 and 8 may be about 12.954 cm.

As set forth above, WCSO 2 may comprise upper and lower low-friction shells 10 and 12 in addition to cable insert halves 4 and upper and lower bodies 6 and 8. In embodiments, upper and lower low-friction shells 10 and 12 may be of similar structure and in the general shape of a hollow, half cylinder with tapered edges 52, end cutouts 54, and shell bolt clearance holes 56. Upper low-friction shell 10 may be disposed on outer surface 34 of upper body 6 and lower low-friction shell 10 may be disposed on outer surface 34 of lower body 8. In embodiments, outer surface 34 of both upper and lower bodies 6 and 8 may comprise low-friction shell recess portions 46 configured in shape to accurately receive upper and lower low-friction shells 10 and 12. In embodiments, low-friction shell recess portions 46 may be disposed about the middle, non-tapered portions of upper and lower bodies 6 and 8. Further, low-friction shell recess portions 46 may comprise insert bolt clearance holes 28, clamping bolt clearance holes 44, shell bolt female threads 48, or any combinations thereof. In embodiments, shell bolt female threads 48 may correspond to shell bolt clearance holes 56. In certain embodiments, as illustrated in FIGS. 2A and 2B, low-friction shell recess portion 46 of upper body 6 may comprise two insert bolt clearance holes 28, two clamping bolt clearance holes 44, and five shell bolt female threads 48, and low-friction shell recess portion 46 of lower body 8 may comprise two insert bolt clearance holes and five shell bolt female threads 48.

In embodiments, upper and lower low-friction shells 10 and 12 may be secured within low-friction shell recess portions 46 via shell bolts 50, shell bolt clearance holes 56, and shell bolt female threads 48. Shell bolts 50 may travel through shell bolt clearance holes 56 and may be received by or fit into corresponding shell bolt female threads 48. In embodiments, shell bolts 50 may be any suitable fasteners, bolts, or screws such as, without limitation, small cap head bolts or screws. In embodiments, shell bolts 50 may have a diameter of 4 mm (i.e., M4 bolts). Further, in addition to shell bolts clearance holes 56, upper and lower low-friction shells 10 and 12 may comprise clamping bolt access ports 58 and insert bolt access ports 60. These ports may allow for the disassembly of WCSO 2, including uncoupling of upper and lower bodies 6 and 8 and/or detaching of cable insert halves 4 from the bodies, without requiring the removal of upper and lower low-friction shells 10 and 12 from upper and lower bodies 6 and 8. Sometimes during the disassembly or removal of WCSO 2 from wireline cable 14, WCSO 2 may become stuck or fixed to the wireline. In such case, a parting tool or special jig may be used to pry WCSO 2 from wireline cable 14. In embodiments, the parting tool may utilize end cutouts 54 of upper and lower low-friction shells 10 and 12 to achieve leverage when disengaging a stuck WCSO 2 from wireline cable 14. In certain embodiments, as illustrated in FIGS. 2A and 2B, upper low-friction shell 10 may comprise two clamping bolt access ports 58, two insert bolt access ports 60, and two end cutouts 54, and lower low-friction shell 12 may comprise two insert bolt access ports 60 and two end cutouts 54.

The two outer shells, upper low-friction shell 10 and lower low-friction shell 12 may be manufactured from any suitable material such as, without limitation, polytetrafluoroethylene (i.e., Teflon), fiber glass, or any other low-friction material. In embodiments, upper and lower low-friction shells 10 and 12 may be manufactured from Teflon. The use of low-friction material for upper and lower low-friction shells 10 and 12 may contribute to minimizing cable drag within a wellbore, and therefore reduce logging tensions and improve force transmission during wireline logging operations. Further, upper and lower low-friction shells 10 and 12 may be available in various sizes to accommodate the size of upper and lower bodies 6 and 8 being used. In embodiments, the length of upper and lower low-friction shells 10 and 12, measured from one tapered edge to another, may be between about 5.0 cine and about 8.0 cm, or alternatively between about 7.0 cm and about 8.0 cm. In embodiments, the length of upper and lower low-tension shells 10 and 12 may be about 7.493 cm.

In further embodiments, WCSO 2 may comprise lanyard holes 62 disposed on both upper and lower bodies 6 and 8. Lanyard holes 62 may travel through one of the tapered portions of upper and lower bodies 6 and 8. As illustrated in FIGS. 2A and 2B, upper body 6 may comprise lanyard hole 62 and lower body may comprise another lanyard hole 62. Lanyard holes 62 may be used to connect WCSO 2 to a lanyard during installation onto wireline 14 for added security and to avoid dropping the device down the wellbore.

When fully assembled, referring once again to FIG. 1, WCSO 2 may have an outside diameter measuring about 5.0 cm or greater. In embodiments, WCSO 2 may have an outside diameter measuring about 7.5 cm. Further, the smooth radial cross-section of WCSO 2 may minimize contact area within the wellbore during logging operations and allow for standoff rotation under the action of cable torque. This may allow for easy rotation of WCSO 2 should wireline cable 14 rotate when it is deployed and retrieved from the wellbore. The general nature of a wireline cable during logging operations is to rotate. Rotation may be caused by opposing lay angles of inner and outer armors and induce unequal torsional forces when tensions are applied. As such, the design of WCSO 2 may allow for easy rotation of wireline cable 14 during logging operations, avoiding, for example, the potential for damage if excessive torque was allowed to build up.

Figure 3A:
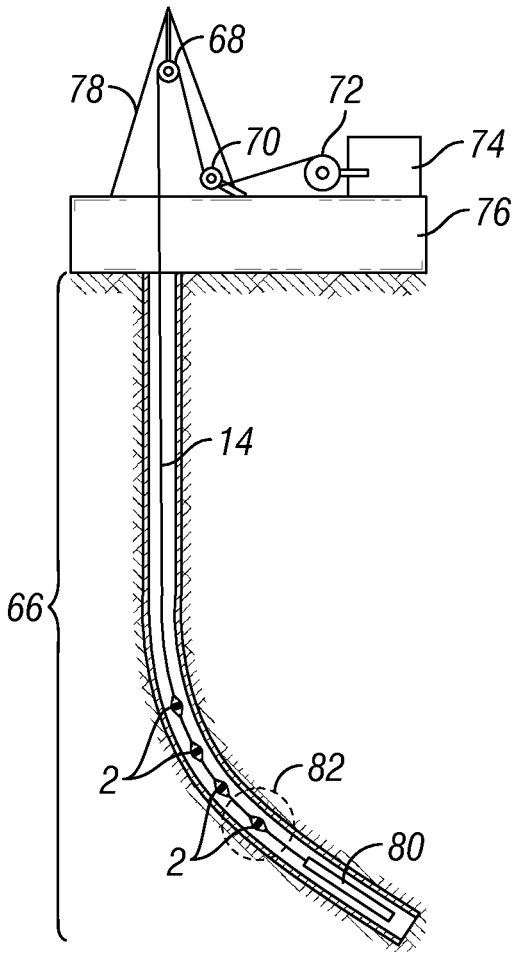
FIG. 3A illustrates a plurality of wireline cased-hole standoffs installed on a wireline cable in accordance with one embodiment of the present invention.
Figure 3B:
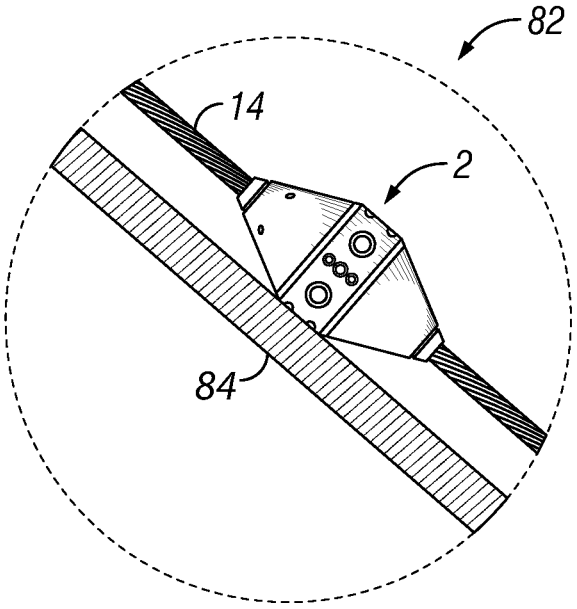
FIG. 3B illustrates a close-up view of a wireline cased-hole standoff in relation to the wellbore wall in accordance with one embodiment of the present invention.

FIG. 3A illustrates a generic logging operation that includes a plurality of WCSOs 2 coupled to wireline cable 14 in accordance with one embodiment of the present invention. As illustrated, plurality of WCSOs 2 may be clamped onto wireline cable 14. Wireline cable 14 may be, for example, stored on a wireline drum 72 and spooled into the well by a winch driver and logging engineer in a logging unit 74. In the illustrated embodiment, logging unit 74 may be fixed to the drilling rig or platform 76, and wireline cable 14 may be deployed through a derrick 78 via at least two sheaves such as an upper sheave 68 and a lower sheave 70 to the maximum depth of the wellbore. The wellbore may be a cased well with cased-hole portion 66. As illustrated, WCSOs 2 may be installed on wireline cable 14 in cased-hole portion 66. A logging tool 80 may be connected to the lower end of wireline cable 14 to take, for example, measurements involving the state of tubing, casing, cement, or perforations of the wellbore. The number of WCSOs 2, and their positions on wireline cable 14 may be determined by a number of factors, including for example, the length of the cased-hole portion 66, the location at which logging tool 80 needs to reach, and the overall trajectory of the wellbore, which may be deviated or directional in nature. FIG. 3B illustrates a close-up view of a single WCSO 2 attachment to wireline cable 14 taken along circle 82. In the illustration of FIG. 3B, WCSO 2 may be seen in relation to wireline cable 14, a wellbore wall 84, and the wellbore.

In embodiments in which plurality of WCSOs 2 may be used on wireline cable 14, high tension and high drag during wireline logging operations may be significantly reduced by minimizing wireline cable 14 contact over a selected zone(s) of a wellbore. WCSOs 2 may be installed on wireline cable 14, for example, to either straddle known dogleg zones where the cutting of casing grooves may be a risk (e.g., eliminating cable contact 100%) or they can be placed at regular intervals along wireline cable 14 to minimize friction, and therefore reduce tension, during logging operations of the wellbore. In certain embodiments, the spacing of WCSOs 2 on wireline cable 14 may be from about 10 feet to about more than 100 feet, depending on the requirements for the particular wellbore being logged.

Although the present invention and its advantages have been described in detail, it should be understood that various changes, substitutions and alterations may be made herein without departing from the spirit and scope of the invention as defined by the appended claims.

What is claimed is:

1. A wireline cased-hole standoff (WCSO) comprising:

a pair of cable insert halves, wherein each cable insert half comprises a flanged end, wherein each flanged end is tapered and comprises a length between 1.0 cm and 3.0 cm;

a pair of opposing WCSO body halves;

a plurality of lanyard holes disposed on both body halves, wherein the plurality of lanyard holes travel through a tapered portion of each body half;

a pair of outer low-friction shells configured to reduce friction between the WCSO and cased-hole, wherein each of the pair of outer low-friction shells is unibody; and one or more fasteners, wherein the one or more fasteners are configured to couple the pair of cable insert halves, the pair of opposing WCSO body halves, and the pair of outer shells together onto a wireline cable.

2. The WCSO of claim 1, wherein the cable insert halves each comprise a length of about 14.478 cm.

3. The WCSO of claim 1, wherein the pair of cable insert halves are concentrically disposed between the wireline cable and the pair of opposing WCSO body halves, wherein the pair of cable insert halves are in direct contact with the wireline cable and at least partially encased within the pair of opposing WCSO body halves.

4. The WCSO of claim 1, wherein the WSCO body halves comprise an upper and lower body each having a general shape of a tapered half cylinder.

5. The WCSO of claim 1, wherein the WSCO body halves each comprise a length of about 12.954 cm.

6. The WCSO of claim 1, wherein the pair of cable insert halves mate together to form a central bore in which to pass the wireline cable.

7. The WCSO of claim 1, wherein the pair of cable insert halves comprise anti-rotation spigot recesses configured to receive anti-rotation spigots disposed on the pair of opposing WCSO body halves.

8. The WCSO of claim 1, wherein the pair of outer shells are disposed in low-friction shell recess portions, wherein the low-friction shell recess portions are disposed on outer surfaces of the pair of opposing WCSO body halves.

9. A wireline assembly comprising:

a wireline cable; and a wireline cased-hole standoff (WCSO), wherein the WCSO comprises:

a pair of cable insert halves, wherein each cable insert half comprises a flanged end, wherein each flanged end is tapered and comprises a length between 1.0 cm and 3.0 cm;

a pair of opposing WCSO body halves, wherein the pair of opposing WCSO body halves comprise dowel pin recesses configured to receive dowel pins, wherein the dowel pin recesses and dowel pins contribute to coupling of the opposing WCSO body halves onto the wireline cable, and further wherein the dowel pins comprise 4×8 mm pins;

a plurality of lanyard holes disposed on both body halves, wherein the plurality of lanyard holes travel through a tapered portion of each body half;

a pair of low-friction outer shells configured to reduce friction between the WCSO and cased-hole; and one or more fasteners, wherein the one or more fasteners are configured to couple the pair of cable insert halves, the pair of opposing WCSO body halves, and the pair of outer shells together onto the wireline cable, and further wherein the one or more fasteners comprise clamping bolts, wherein the clamping bolts comprise a diameter of 8 mm.

10. The WCSO of claim 9, wherein the cable insert halves each comprise a length of about 14.478 cm.

11. The WCSO of claim 9, wherein the pair of cable insert halves are concentrically disposed between the wireline cable and the pair of opposing WCSO body halves, wherein the pair of cable insert halves are in direct contact with the wireline cable and at least partially encased within the pair of opposing WCSO body halves.

12. The WCSO of claim 9, wherein the WSCO body halves comprise an upper and lower body each having a general shape of a tapered half cylinder.

13. The WCSO of claim 9, wherein the WSCO body halves each comprise a length of about 12.954 cm.

14. The WCSO of claim 9, wherein the pair of cable insert halves mate together to form a central bore in which to pass the wireline cable.

15. A method for reducing wireline cable drag and tension during wireline logging operations comprising:

coupling one or more wireline cased-hole standoffs (WCSOs) to a wireline cable, wherein the one or more WCSOs comprise:

a pair of cable insert halves, wherein each cable insert half comprises a flanged end, wherein each flanged end is tapered and comprises a length between 1.0 cm and 3.0 cm;

a pair of opposing WCSO body halves;

a plurality of lanyard holes disposed on both body halves, wherein the plurality of lanyard holes travel through a tapered portion of each body half;

a pair of outer low-friction shells configured to reduce friction between the WCSO and cased-hole; and one or more fasteners, wherein the one or more fasteners are configured to couple the pair of cable insert halves, the pair of opposing WCSO body halves, and the pair of outer shells together onto the wireline cable, wherein the one or more fasteners comprise shell bolts configured to secure the pair of outer shells to the opposing WCSO body halves, wherein the shell bolts travel through shell bolt clearance holes disposed on the outer shells and are received by shell bolt female threads disposed on the opposing WCSO body halves, and further wherein the shell bolts comprise a diameter of 4 mm.

16. The WCSO of claim 15, wherein the cable insert halves each comprise a length of about 14.478 cm.

17. The WCSO of claim 15, wherein the pair of cable insert halves are concentrically disposed between the wireline cable and the pair of opposing WCSO body halves, wherein the pair of cable insert halves are in direct contact with the wireline cable and at least partially encased within the pair of opposing WCSO body halves.

18. The WCSO of claim 15, wherein the WSCO body halves comprise an upper and lower body each having a general shape of a tapered half cylinder.

19. The WCSO of claim 15, wherein the WSCO body halves each comprise a length of about 12.954 cm.

20. The WCSO of claim 15, wherein the pair of cable insert halves mate together to form a central bore in which to pass the wireline cable.

* * * * *